US007385338B1

(12) United States Patent
Garcia

(10) Patent No.: US 7,385,338 B1
(45) Date of Patent: Jun. 10, 2008

(54) CYLINDRICAL LAMP EMPLOYING INTERNAL REFLECTOR

(75) Inventor: Ceferino H. Garcia, Juarez (MX)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 11/643,335

(22) Filed: Dec. 21, 2006

(51) Int. Cl.
*H01J 5/16* (2006.01)
*H01J 61/40* (2006.01)
*H01K 7/02* (2006.01)

(52) U.S. Cl. ..... 313/113; 313/114; 313/271; 313/578

(58) Field of Classification Search ..... 313/113, 313/114, 573, 271, 318.11, 635, 578
See application file for complete search history.

(56) References Cited

U.S. PATENT DOCUMENTS 3,523,207 A * 8/1970 Corth et al. ..... 313/113
3,639,750 A * 2/1972 Anthonijsz ..... 362/659
3,983,513 A 9/1976 DeCaro ..... 313/113
4,287,231 A * 9/1981 DeCaro et al. ..... 427/106
4,964,829 A * 10/1990 Westlund et al. ..... 445/22
5,169,228 A * 12/1992 Breitzler ..... 362/293
5,582,480 A * 12/1996 Zwick et al. ..... 362/298
5,660,462 A * 8/1997 Bockley et al. ..... 362/256
7,036,967 B2 * 5/2006 Morishita et al. ..... 362/517

* cited by examiner

*Primary Examiner*—Karabi Guharay
(74) *Attorney, Agent, or Firm*—William E. Meyer

(57) ABSTRACT

A lamp (10) comprising an hermetically sealed, cylindrical envelope (12) arrayed about a longitudinal axis (13); two filament supports (14, 16) sealed in the envelop; a filament (18) fixed between the filaments supports; and an internal reflector (20) in the envelope for directing light emitted from the filament outwardly from the envelope.

4 Claims, 1 Drawing Sheet

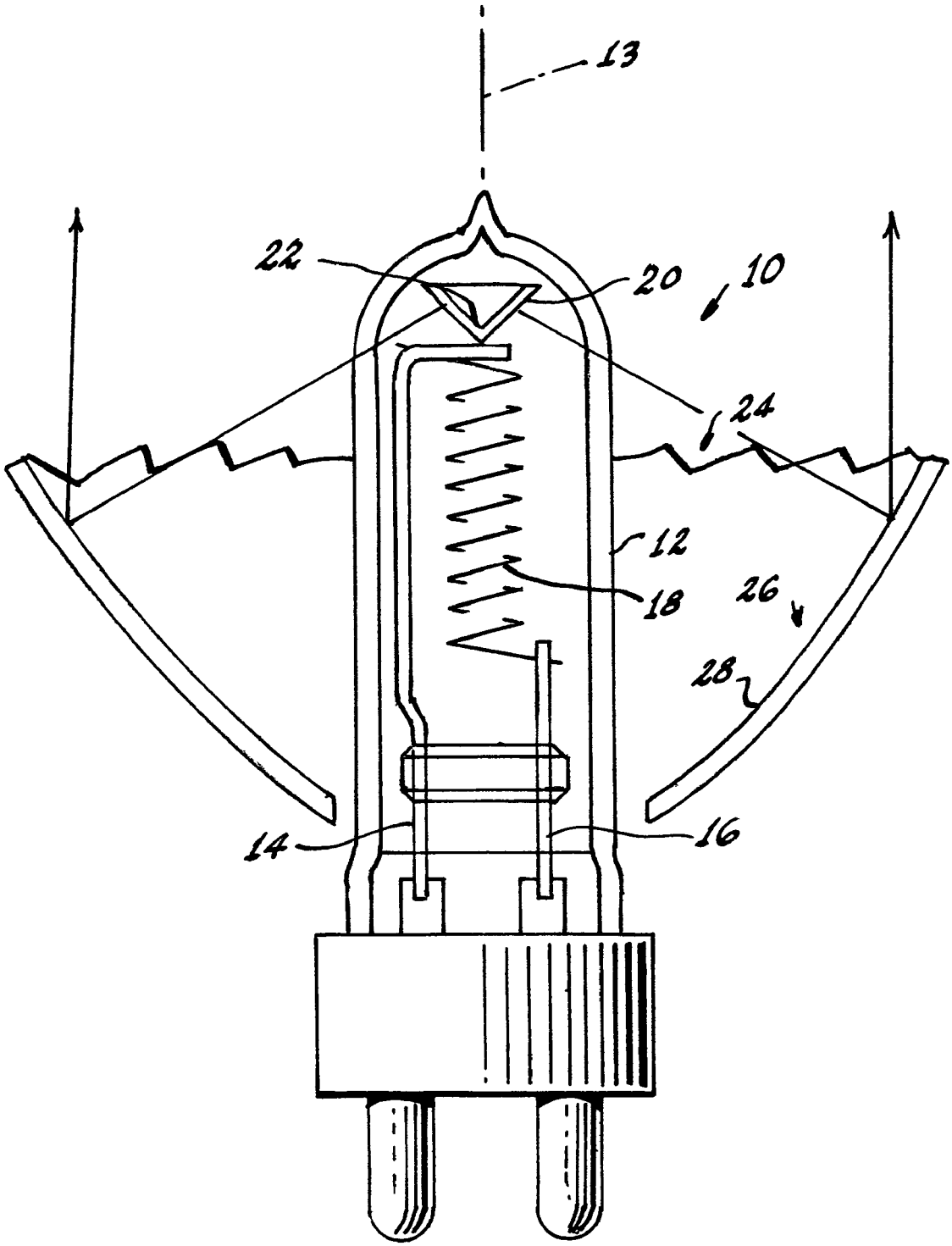
13
22
20
10
24
12
18
26
28
14
16

CYLINDRICAL LAMP EMPLOYING INTERNAL REFLECTOR

TECHNICAL FIELD

This invention relates generally to lamps and more particularly to lamps having increased light output.

BACKGROUND ART

Increasing the light output of any given lamp is a constant effort. Beyond gaining small advantages by tweaking the filament or the environment in which the filament operates it is generally necessary supply more power, that is, increase the wattage. While the latter technique works, it also increases the cost of operation. Therefore, it is desirable to increase the light out put of lamps without increasing the wattage. U.S. Pat. No. 3,983,513, issued Sep. 28, 1976, suggests that this can be accomplished by providing a reflective coating on the inside of a portion of large spherical or hemispherical lamp envelopes; however, providing internal coatings on lamp envelopes is a difficult and costly endeavor. Also, such a technique does not readily adapt to cylindrical lamp envelopes.

DISCLOSURE OF INVENTION

It is, therefore, an object of the invention to obviate the disadvantages of the prior art.

It is another object of the invention to enhance the operation of lamps.

These objects are accomplished, in one aspect of the invention, by the provision of a lamp comprising: an hermetically sealed, cylindrical envelope arrayed about a longitudinal axis; two filament supports sealed in the envelop; a filament fixed between the filaments supports; and an internal reflector in the envelope for directing light emitted from the filament outwardly from the envelope. The filaments can be of various configurations, such as multiple segments, a vertical coil or a horizontal coil.

The invention is applicable to filamented lamps with one or more filaments and multiple atmospheres, including those lamps designed to operate on the known tungsten-halogen cycle.

BRIEF DESCRIPTION OF THE DRAWING

The single FIGURE is an elevational view of an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown a lamp 10 that can be a lamp for operating on a tungsten-halogen cycle. The lamp 10 comprises an hermetically sealed, cylindrical envelope 12 of a suitable transparent material such as glass, arrayed about a longitudinal axis 13. Two filament supports 14, 16 are sealed in the envelope and a filament 18 is fixed between them. As shown in the FIGURE the filament 18 is vertical; however, this is exemplary, and horizontal filaments or multiple filaments can also be employed. An internal reflector 20 is fixed in the top portion of the lamp, as by welding to one of the supports, for example 14. The internal reflector 20 directs light emitted from the filament outwardly from the lamp envelope 12 so that it can be reflected from a major reflector 26 and preferably is constructed from tungsten or molybdenum or other suitable material that can withstand the environment of a halogen lamp.

In a preferred embodiment of the invention the internal reflector 20 is conical and has its apex 22 directed toward the filament 18.

While the advantages of this internal reflector 20 are achieved in any cylindrical lamp, it is particularly advantageous if the envelope contains a filament-enhancing atmosphere, for example, an atmosphere containing a halogen.

The internal reflector 20 is mounted such that the apex 22 is on the longitudinal axis 13.

In use, the lamp 10 is employed in a fixture assembly 24 that comprises a major reflector 26 that has a concave reflecting surface 28. As used herein the term "concave reflector" is to have its broadest meaning to include spherical, hemispherical, parabolic or combinations of these curves as well as any other curve that can be desirable.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A lamp comprising:

an hermetically sealed, cylindrical envelope arrayed about a longitudinal axis;

first and second filament supports sealed in said envelop, said first filament support extending parallel to said longitudinal axis and spaced therefrom and including a transverse portion that projects across said longitudinal axis;

a filament coaxial with said longitudinal axis and fixed between said transverse portion of said first filament support and said second filament support; and a conical internal reflector in said envelope for directing light emitted from said filament outwardly from said envelope, said internal reflector being constructed from tungsten or molybdenum and being attached to said transverse portion of said first filament support at its apex, said apex being located on said longitudinal axis.

2. The lamp of claim 1 wherein said envelope contains a filament-enhancing atmosphere.

3. The lamp of claim 2 wherein said filament enhancing atmosphere is selected from the group comprising a halogen containing atmosphere or an inert gas.

4. A lamp-fixture assembly comprising:

a major reflector having a concave reflecting surface that includes a lowest point; and a lamp comprising:

an hermetically sealed, cylindrical envelope arrayed about a longitudinal axis first and second filament supports sealed in said envelope, said first filament support extending parallel to said longitudinal axis and spaced therefrom and including a transverse portion that projects across said longitudinal axis;

a filament coaxial with said longitudinal axis and fixed between said transverse portion of said first filament support and said second filament support; and a conical internal reflector in said envelope for directing light emitted from said filament outwardly from said envelope, said internal reflector being formed from tungsten or molybdenum and being attached to said transverse portion of said first filament support at its apex, said apex being located on said longitudinal axis, said lamp being mounted substantially at said lowest point of said major reflector.

* * * * *